US005425331A

United States Patent [19]

Abdulally

[11] Patent Number: 5,425,331

[45] Date of Patent: Jun. 20, 1995

[54] CIRCULATING FLUIDIZED BED REACTOR FOR LOW GRADE FUELS

[75] Inventor: Iqbal F. Abdulally, Randolph, N.J.

[73] Assignee: Foster Wheeler Energy Corporation, Clinton, N.J.

[21] Appl. No.: 259,098

[22] Filed: Jun. 13, 1994

[51] Int. Cl.[6] ..... B09B 3/00; F22B 1/00

[52] U.S. Cl. ..... 122/4 D; 165/104.16; 34/578; 432/58; 110/245

[58] Field of Search ..... 110/298, 299, 300, 245; 165/104.16; 122/371, 374, 4 D; 431/7, 170; 34/363, 578, 582; 432/58; 422/143

[56] References Cited

U.S. PATENT DOCUMENTS

| | | | |
|---|---|---|---|
| 3,016,624 | 1/1962 | Bliss | 422/143 X |
| 3,460,491 | 8/1969 | Bryk et al. . | |
| 3,834,326 | 9/1974 | Sowards . | |
| 4,060,041 | 11/1977 | Sowards . | |
| 4,075,953 | 2/1978 | Sowards . | |
| 4,279,207 | 7/1981 | Wormser . | |
| 4,402,665 | 9/1983 | Korenberg . | |
| 4,510,021 | 4/1985 | Sowards . | |
| 4,614,167 | 9/1986 | Bergkvist | 122/4 D |
| 4,622,904 | 11/1986 | Murphy et al. . | |
| 4,823,712 | 4/1989 | Wormer . | |
| 4,828,482 | 5/1989 | Gohara . | |
| 4,860,694 | 8/1989 | Walker . | |
| 4,908,124 | 3/1990 | Goldbach et al. . | |
| 5,026,269 | 6/1991 | Ruottu . | |

FOREIGN PATENT DOCUMENTS

| | | | |
|---|---|---|---|
| 2073041 | 10/1981 | United Kingdom | 422/143 |

*Primary Examiner*—Denise L. Gromada
*Attorney, Agent, or Firm*—Marvin A. Naigur

[57] ABSTRACT

A fluidized bed reactor in which a plurality of air bars are supported by a plurality of tubes in an upright enclosure. The air bars support a bed of particulate material and discharge air into the bed to fluidize the material. A cooling fluid is passed through the tubes to transfer heat from the air bars.

10 Claims, 1 Drawing Sheet

CIRCULATING FLUIDIZED BED REACTOR FOR LOW GRADE FUELS

FIELD OF THE INVENTION

This invention relates to an improved fluidized bed reactor, and more particularly, to a fluidized bed reactor for the incineration of waste fuels containing tramp material and for the removal of the tramp material during incineration.

BACKGROUND OF THE INVENTION

The use of fluidized bed reactors for the incineration of waste fuels, such as municipal refuse containing tramp material, is generally known and involves the burning of the waste fuels with air while fluidizing it in a fluidized bed. In order to improve the combustion along with the fluidizing of the waste fuels, a bed make-up material, such as crushed limestone, sand, and/or clay are fed together with the waste fuels to the fluidized bed.

A typical fluidized bed reactor for the incineration of the waste fuels is equipped with a bar grate in the lower section of the reactor body which is designed to provide fluidizing air to the fluidized bed while allowing ash, spent bed make-up material and tramp material to pass through the spaces between a plurality of bars disposed in the bar grate. The upper section of the reactor body is equipped with a waste fuel feeding unit and a bed make-up material feeding unit. The waste fuel is burned while the waste fuel and the bed make-up material are fluidized by primary air which is blown out through air nozzles connected to the bars. The bars are typically lined with a suitable insulating material, such as a furnace refractory.

The waste fuels are generally of low calorie content and contain a high percentage of tramp material that does not burn. As the waste fuels are fed to the fluidized bed, the volatile organic compounds are burned and the tramp material, such as bottles and cans, as well as ash and spent bed make-up material, are left in the fluidized bed.

As the organic compounds are decomposed and burned within the fluidizing bed, the tramp material, along with the spent bed make-up material and ash, descends downwardly through the reactor and passes through the spaces between the bars disposed in the bar grate. The bed material is thus discharged to external equipment and a portion of the bed make-up material is separated from the tramp material and returned to the fluidized bed.

Conventionally, such reactors use refractory materials to line the surfaces of the bars disposed in the bar grate to insulate the bars from the elevated temperatures in the lower section of the reactor. The elevated temperatures result in the adhesion of slag particles to the refractory lining in the reactor resulting in the slow erosion and subsequent maintenance of the refractory materials. Consequently, such reactors use excessive amounts of fluidizing gases in order to lower the temperature within the reactor and thereby reduce the maintenance costs associated with the repair and replacement of the refractory materials within the reactor. In spite of this precaution, refractories within such reactors must undergo frequent routine maintenance and must be completely replaced approximately every other year.

SUMMARY OF THE INVENTION

It is therefore an object of the present invention to provide a fluidized bed reactor for economically combusting waste fuels, such as municipal refuse.

It is still a further object of the present invention to provide a reactor of the above type for reducing or eliminating the use of refractory materials and the associated maintenance.

It is still a further object of the present invention to provide a reactor of the above type for reducing the temperature of the bar grate via water-cooling.

Toward the fulfillment of these and other objects, the reactor of the present invention features a circulating fluidized bed reactor with a plurality of water-cooled support tubes that provide mechanical support and water-cooling to a bar grate disposed in the lower portion of the reactor. Further, a water-cooled hopper is disposed below the bar grate which provides for the extraction of heat from the spent bed material.

BRIEF DESCRIPTION OF THE DRAWINGS

The above brief description as well as further objects, features and advantages of the system and method of the present invention will be more fully appreciated by reference to the following detailed description of presently preferred but nonetheless illustrative embodiment in accordance with the present invention when taken in conjunction with the accompanying drawing in which.

DESCRIPTION OF THE PREFERRED EMBODIMENT

Figure 1:
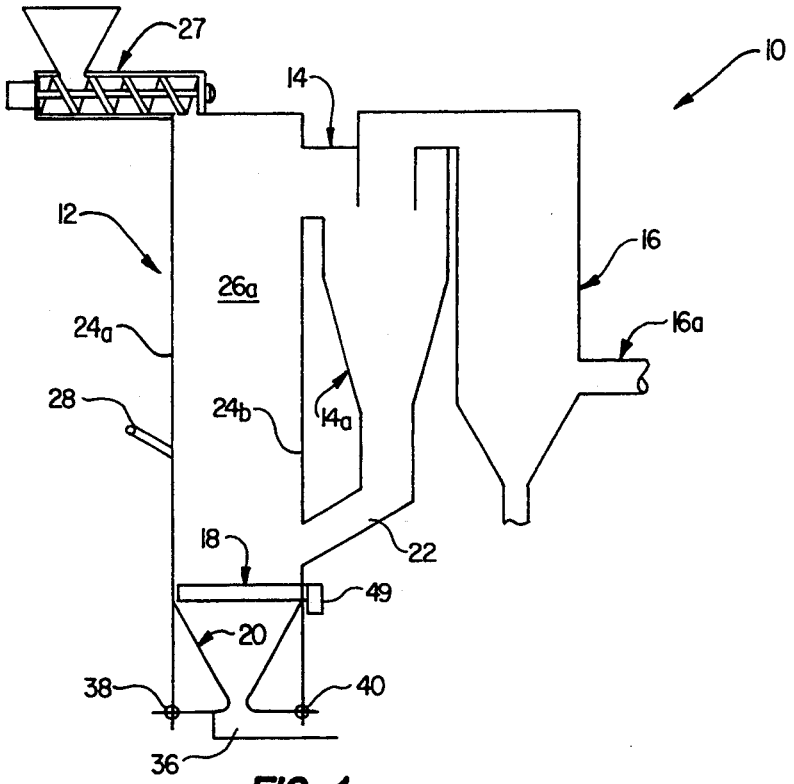
FIG. 1 is a schematic view depicting a steam generation system including the fluidized bed reactor of the present invention.

Referring to FIG. 1 of the drawings, the reference numeral 10 refers in general to a steam generating system, which includes a fluidized bed reactor 12, a cyclone separator 14 and a heat recovery area 16. A water-cooled bar grate 18 and a water-cooled hopper 20 are provided in the lower portion of the fluidized bed reactor 12 and will be described in detail. The cyclone separator 14 receives a mixture of air and the gaseous products of combustion from the fluidized bed reactor 12 along with a plurality of solid particles entrained thereby. The separator 14 operates to separate the solids from the gases, and the latter are passed to the heat recovery area 16. The solids from the separator 14 fall down into a hopper section 14a of the separator where they are reinjected, via a recycle conduit 22, to the lower portion of the reactor section 12. The gases, after passing through the heat recovery area 16, exit via an outlet conduit 16a.

The fluidized bed reactor 12 includes a front wall 24A, a spaced, parallel rear wall 24B, and two spaced, parallel side walls 26A and 26B (FIG. 3) which extend perpendicular to the front and rear walls to form an enclosure.

A silo-hopper and screw-feeder 27 is disposed above the fluidized bed reactor and registers with an opening formed in its roof for introducing waste fuels, such as municipal refuse, onto the upper surface of a fluidized bed disposed above the bar grate 18. The waste fuel may contain tramp material, such as bottles and cans.

A distributor 28 extends through the front wall 24A for introducing bed make-up material onto the upper surface of the fluidized bed. This make-up material consists, in general of sand and/or limestone, or dolomite, for absorbing the sulfur oxides released during the combustion of the waste fuel. It is understood that other distributors can be associated with the walls 24A, 24B, 26A and 26B for distributing bed make-up material onto the bed, as needed.

Figure 2:
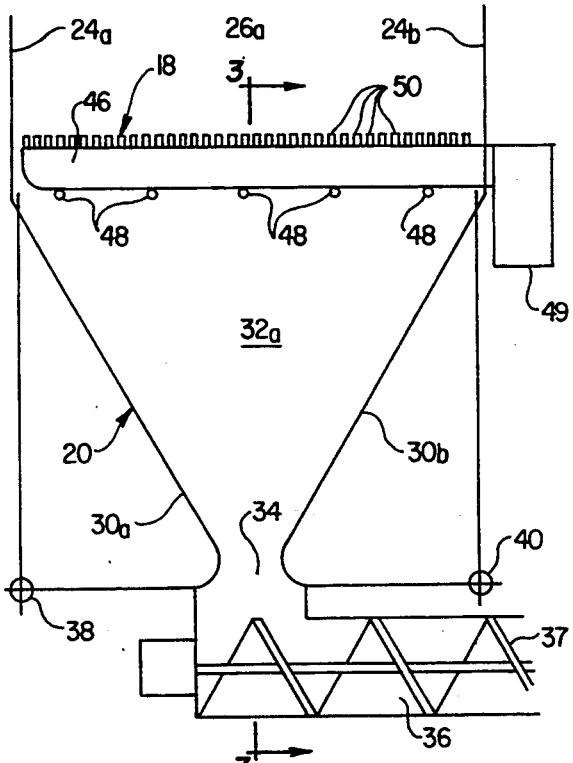
FIG. 2 is an enlarged schematic view depicting the water-cooled bar grate and hopper of the present invention.
Figure 3:
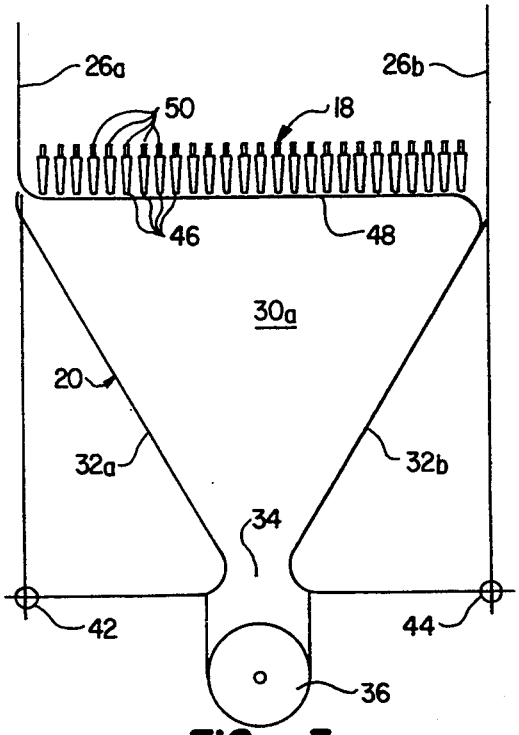
FIG. 3 is a cross-sectional view along line 3—3 of FIG. 2.

As better shown in FIGS. 2 and 3, the hopper 20 includes a front wall 30A, a spaced rear wall 30B and two spaced side walls 32A and 32B which extend perpendicular to the front and rear walls to form the hopper 20. The walls 30A, 30B, 32A and 32B of the hopper 20 are substantially tapered toward the bottom and are connected to form an air tight enclosure with an frustoconical shape. An opening 34 is formed in the base of the hopper 20 by bending the tubes forming the walls 30A, 30B, 32A and 32B back toward the walls of the reactor 12. A duct 36 is disposed below, and is in communication with, the hopper 20. A worm screw 37 (FIG. 2) is disposed within the duct 36 for purposes that will be described.

The walls of 24A, 24B, 26A and 26B of the reactor 12 and the walls of the hopper 30A, 30B, 32A, and 32B are formed by a plurality of tubes interconnected by elongated bars, or fins, to form a contiguous, air-tight structure. The ends of the tubes of the walls 24A, 24B, 26A, 26B, 30A, 30B, 32A and 32B are connected to horizontally-disposed upper and lower headers, the latter of which are shown by the reference numerals 38, 40, 42 and 44. Since this type of arrangement is conventional, it is not shown in the drawings nor will it be described in any further detail.

As shown in FIG. 2, the tubes forming the wall 24A extend from the upper portion of the reactor 12 down to an area just below the grate 18 where a portion of the tubes are bent inwardly at an angle to form the wall 30A of the hopper 20 and then back horizontally where they are connected to the header 38, and the remaining portion of the tubes continue to extend vertically directly to the header. Similarly, the tubes forming the wall 24B extend down to an area just below the grate 18 where a portion of the tubes are bent inwardly at an angle to form the wall 30B of the hopper 20 and then back horizontally where they are connected to the header 40, and the remaining portion of the tubes continue to extend vertically directly to the header. It is understood that the tubes forming the hopper walls 30A, 30B and the tubes forming the reactor walls 24A, 24B can, for example, be disposed in an alternating relationship.

As shown in FIG. 3, the tubes forming the wall 26A extend from the upper portion of the reactor 12 down to an area just below the grate 18 where a first portion of the tubes are bent inward horizontally across the grate to form the support tubes 48 and then back downwardly at an angle to form a portion of the wall 32B and then back horizontally where they connect to the header 44. A second portion of the tubes forming the wall 26A are bent downwardly at an angle to form the wall 32A of the hopper 20 and then back horizontally where they are connected to the header 42. The remaining portion of the tubes forming the wall 26A extend vertically directly to the header 42.

The tubes forming the wall 26B extend from the upper portion of the reactor 12 down to an area just below the grate 18 where a portion of the tubes are bent downwardly at an angle to form the remaining portion of the wall 32B of the hopper 20 and then back horizontally where they are connected to the header 44. The remaining portion of the tubes forming the wall 26B extend vertically directly to the header 44. For example, the tubes forming the hopper walls 32B and the tubes forming the reactor walls 26B can be disposed in an alternating relationship.

The bar grate 18 is formed by a plurality of hollow air bars 46 which are adapted to support the bed of make-up material and which are suitably supported in the lower portion of the reactor 12 by a plurality water-cooled, support tubes 48 which continually transfer heat from the air bars to the water flowing in the pipes. The air bars 46 extend perpendicular to, and in air flow communication with, a plenum chamber 49 disposed externally of the hopper 20 and adjacent the wall **24*b*. Pressurized air from a suitable source (not shown) is introduced into the chamber 49** by conventional means, such as a forced-draft blower, or the like.

A plurality of bubble caps 50 for dispersing fluidizing air into the bed material are suitably supported by, and are in air flow communication with, each air bar 46. The air introduced through the plenum chamber 49 thus passes horizontally through the air bars 46, upwardly through the bubble caps 50 and is discharged into the bed material. It is understood that the air may be preheated by burners (not shown) and appropriately regulated by air control dampers as needed.

The air bars 46 are sufficiently spaced apart to allow for passage of the largest tramp material normally encountered in the waste fuels being combusted. Further, the air bars 46 have sufficient internal dimensions to carry the volume of air necessary to fluidize the bed make-up material. As shown in FIG. 3, the side walls of the air bars 46 converge downwardly to expedite the passage of the tramp material.

In the operation of the steam generator 10, a quantity of waste fuel and bed make-up material are introduced through the screw feeder 27 and the distributor 28, respectively, and build up on the upper surface of the grate 18. Fluidizing gas from an external source is supplied to the plenum chamber 49 at sufficient volume and pressure to cause the bed make-up material above the grate 18 to become fluidized. Burners (not shown) are disposed in the plenum chamber 49 to raise the temperature of the fluidizing gas to a temperature sufficient to commence the burning of the waste fuel material disposed above the grate 18. Auxiliary fuel, such as coal, may be provided by the distributor 28 in the event that the waste fuel has low calorie content. Once the waste fuel inside the reactor 12 starts burning with the fluidizing gas, ignition by the burners and/or the auxiliary fuel is reduced or ceased as needed.

As the combustion progresses, additional waste fuel and bed make-up material are introduced through the screw feeder 27 and the distributor 28, respectively, to the reactor 12. The uncombusted tramp material, ash and spent bed make-up material (hereinafter referred to as incombustible solids), are gravitationally and pneumatically transported downwardly as the fluidizing gas and the products of combustion move upwardly within the reactor 12. The incombustible solids move downwardly through the reactor 12 to the upper surface of the bar grate 18, pass downwardly through the bar grate 18 between the air bars 46 and the support tubes 48 and continue to descend within the hopper 20 as heat is extracted from the bed material by the water-cooled walls 30A, 30B, 32A and 32B of the hopper. The incombustible solids exit the hopper 20 though the opening 34 in the base of the hopper and are removed by the worm screw 37. A portion of the incombustible solids are subsequently screened to remove the tramp material and any agglomerations that can form during the combustion of the waste fuel, and returned to the fluidized bed within the reactor 12 at a rate required to maintain the inventory of the bed make-up material.

During the descent of the spent bed material through the plenum 20, heat is continuously transferred from the bed material to the water flowing through the tubes forming the reactor walls 24A, 24B, 26A and 26B, and the hopper walls 30A, 30B, 32A and 32B, as well as the headers including the lower headers 38, 40, 42 and 44 which water is in the flow circuit of the naturally circulating steam generator 10 in a conventional manner. The heat absorbed by the air bars 46 and the support tubes 48 is transferred to the water flowing through the latter tubes which water is also in the latter flow circuit.

It is thus seen that the reactor of the present invention results in several advantages. For example, the support tubes 48 perform the duel function of supporting the air bars 46 and transferring heat from the air bars to the water flowing through the tubes 48 to minimize the adhesion of slag particles to the air bars. Also, the downward convergence of the side walls of the air bars 46 permits any tramp material which falls against the upper surface of the bar grate 18 to more easily pass through the spaces between adjacent air bars 46 as the spaces become progressively wider toward the bottom surface of the air bars. Further, this arrangement reduces the amount of clogging by tramp material between the bars 46 since such material will fall cleanly through the grate 18 once passing the narrowest point of the grate. In addition, the use of water-cooled support tubes 48 results in a rapid cooling of the slag particles that come in contact with the bar grate which prevents the adhesion of the slag particles to the bar grate. Further, the use of a water-cooled grate within a fluidized bed reactor eliminates the need to use excessive amounts of fluidizing gases to reduce the temperature within the reactor which results in a reduction in the size of equipment, such as, cyclone separators, baghouse filters, and the like. Also, the use of a water-cooled grate and a water-cooled hopper within a reactor substantially reduces design requirements for reactor refractories, reducing reactor operation and maintenance costs.

It is understood that variations, modifications, changes and substitutions can be made by those skilled in the arts without departing from the invention as defined in the appended claim. Accordingly, it is appropriate that the appended claims be construed broadly and in a manner consistent with the scope of the invention.

What is claimed is:

1. A fluidized bed reactor, comprising:

an enclosure comprising a plurality of upright walls formed by a plurality of tubes for receiving cooling fluid;

a plurality of hollow spaced air bars disposed in the lower portion of said enclosure for supporting a bed of particulate material including fuel and incombustible solids;

means for supplying pressurized air to said air bars for discharge into said bed to fluidize said particulate material and promote the combustion of said fuel, said air bars absorbing heat from said combustion;

a plurality of spaced tubes integral, and in flow communication, with said tubes of said walls for receiving cooling fluid to transfer heat from said air bars to said cooling fluid; and a hopper disposed in said enclosure and extending below said air bars for collecting said incombustible solids that pass between said air bars, said hopper including walls formed by a plurality of tubes for receiving a cooling fluid.

2. The fluidized bed reactor of claim 1 wherein a portion of the tubes forming one of said upright walls are bent out of the plane of said latter wall to form said tubes of said heat transferring means.

3. The fluidized bed reactor of claims 1 or 2 wherein said air bars are supported by said tubes of said heat transferring means.

4. The fluidized bed reactor of claim 3 wherein said tubes of said heat transfer means extend across said enclosure and said air bars rest on said latter tubes.

5. The fluidized bed reactor of claim 1 further comprising discharge means in air flow communication with said bars for receiving said air from said bars and discharging it to said fluidized bed.

6. The reactor of claim 5 wherein said discharge means comprises a plurality of bubble caps associated with each air bar and adapted to receive air from said air bar and discharge air into said particulate material.

7. The fluidized bed reactor of claim 1 wherein said tubes of said hopper are in fluid flow communication with said tubes of said enclosure-defining means.

8. The fluidized bed reactor of claim 7 wherein said tubes of said heat-transferring means are in water flow communication with said tubes of said hopper and with said tubes of said enclosure-defining means.

9. The fluidized bed reactor of claim 1 further comprising a duct disposed below said hopper for the removal of said incombustible solids.

10. The fluidized bed reactor of claim 1 wherein said heat-transferring means supports said air bars in said enclosure.

* * * * *